US011727901B2

(12) United States Patent
May

(10) Patent No.: US 11,727,901 B2
(45) Date of Patent: Aug. 15, 2023

(54) ACOUSTIC VALVE PORTING ELEMENT

(71) Applicant: Randall L. May, Irvine, CA (US)

(72) Inventor: Randall L. May, Irvine, CA (US)

(73) Assignee: Randall May International Incorporated, Irvine, CA (US)

( * ) Notice: Subject to any disclaimer, the term of this patent is extended or adjusted under 35 U.S.C. 154(b) by 0 days.

(21) Appl. No.: 17/844,367

(22) Filed: Jun. 20, 2022

(65) Prior Publication Data

US 2022/0366877 A1 Nov. 17, 2022

Related U.S. Application Data

(63) Continuation of application No. 17/016,106, filed on Sep. 9, 2020, now Pat. No. 11,367,422, which is a continuation of application No. 16/258,222, filed on Jan. 25, 2019, now Pat. No. 10,805,717.

(60) Provisional application No. 62/622,074, filed on Jan. 25, 2018.

(51) Int. Cl.
*H04R 1/28* (2006.01)
*G10D 13/10* (2020.01)

(52) U.S. Cl.
CPC ..... *G10D 13/10* (2020.02); *G10D 13/25* (2020.02); *H04R 1/2819* (2013.01); *H04R 1/2826* (2013.01)

(58) Field of Classification Search
CPC ..... G10D 13/02; G10D 13/10; G10D 13/25; H04R 1/2819; H04R 1/2816
See application file for complete search history.

(56) References Cited

U.S. PATENT DOCUMENTS

| | | | | |
|---|---|---|---|---|
| 4,026,185 | A * | 5/1977 | Migirian | G10D 13/10 84/411 R |
| 6,700,044 | B1 | 3/2004 | Bencomo, Jr. | |
| 6,927,330 | B2 | 8/2005 | May | |
| 7,148,413 | B2 | 12/2006 | May | |
| 7,256,342 | B2 | 8/2007 | Hagiwara et al. | |
| 7,961,900 | B2 * | 6/2011 | Zurek | H04M 1/605 379/433.02 |
| 9,190,037 | B2 | 11/2015 | May | |
| 10,156,348 | B2 | 12/2018 | Kirsch | |
| 10,165,348 | B2 * | 12/2018 | Kirsch | H04R 3/04 |

FOREIGN PATENT DOCUMENTS

GB 641718 A 8/1950

* cited by examiner

*Primary Examiner* — Brian Ensey
(74) *Attorney, Agent, or Firm* — Crowell & Moring LLP

(57) ABSTRACT

An acoustic variable porting system includes an acoustic element and an acoustic variable porting element forming a port into the acoustic element. The acoustic variable porting element is adjustable between at least an open position, in which the port is generally open, and a closed position, in which the port is generally closed. The acoustic element may be at least one of: a sub-kick, a ported drum, and a speaker.

18 Claims, 18 Drawing Sheets

ACOUSTIC VALVE PORTING ELEMENT

CROSS-REFERENCE TO RELATED APPLICATIONS

This application is a continuation of U.S. application Ser. No. 17/016,106, filed on Sep. 9, 2020, which is a continuation of U.S. application Ser. No. 16/258,222, filed on Jan. 25, 2019 which claims priority to Application No. 62/622,074, filed on Jan. 25, 2018, the entire contents of which are hereby expressly incorporated by reference herein.

BACKGROUND OF THE INVENTION

This invention relates to improvements in sound reinforcement for percussion instruments, percussion resonating drum heads, and speaker enclosures, namely, to acoustic valve porting elements for adjusting low frequency sound quality.

The sub-kick structure (or other speaker structure) is acoustically vented via adjustable valves or registers. This permits altering of the ratio of back pressure to the speaker-microphone of the sub-kick (or speaker of the other sound source), and the ratio of reflective surfaces exposed or sonically transparent. In sub-kick embodiments, the speaker-microphone may also be longitudinally adjustable either or both of: with the sub-kick housing and internally within it. This permits altering the proximity to reflective surfaces and to the sound sources.

Various objects, features, aspects, and advantages of the described invention will become apparent from the following detailed description, taken in conjunction with the accompanying drawings, which illustrate, by way of example, the principles of the described invention. It should be recognized that the one or more examples in the disclosure are non-limiting examples and that the present invention is intended to encompass variations and equivalents of these examples. The disclosure is written for those skilled in the art. Although the disclosure use terminology and acronyms that may not be familiar to the layperson, those skilled in the art will be familiar with the terminology and acronyms used herein.

BRIEF DESCRIPTION OF THE DRAWINGS

The features, objects, and advantages of the present invention will become more apparent from the detailed description, set forth below, when taken in conjunction with the drawings, in which like reference characters identify elements correspondingly throughout.

DETAILED DESCRIPTION OF THE PREFERRED EMBODIMENTS

Figure 1:
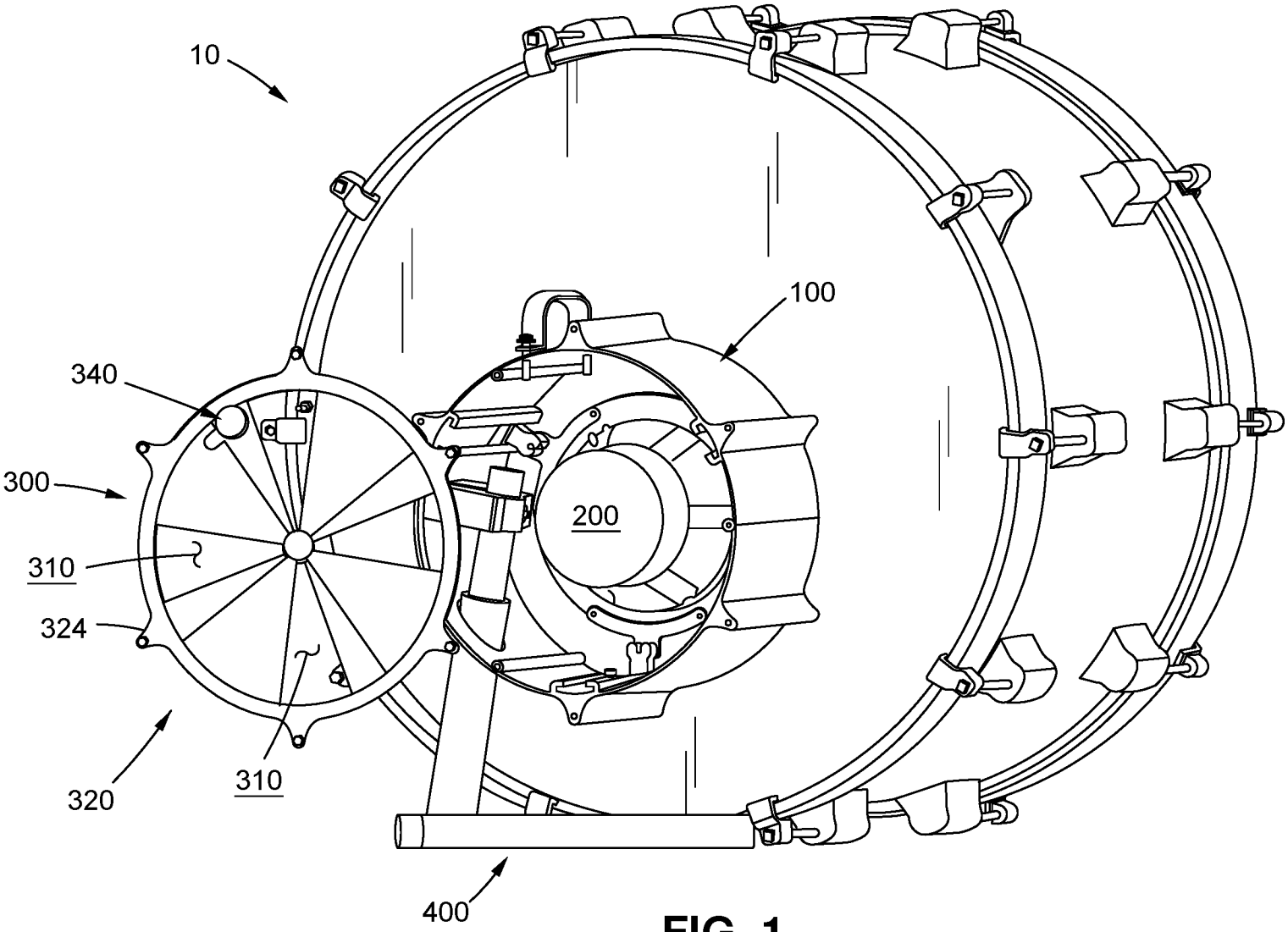
FIGS. 1-6 illustrate an exemplary AVP sub-kick system according to at least one embodiment.
Figure 2:
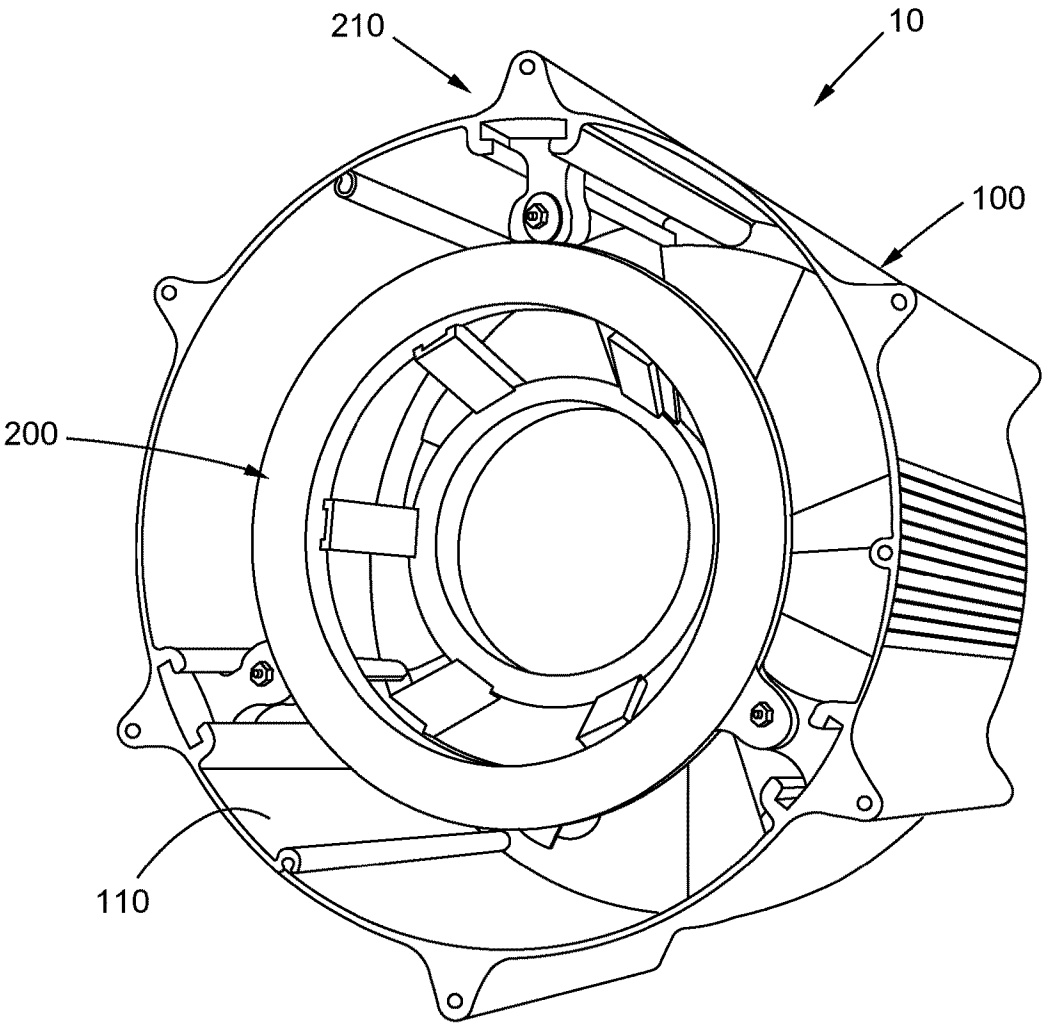
Figure 3:
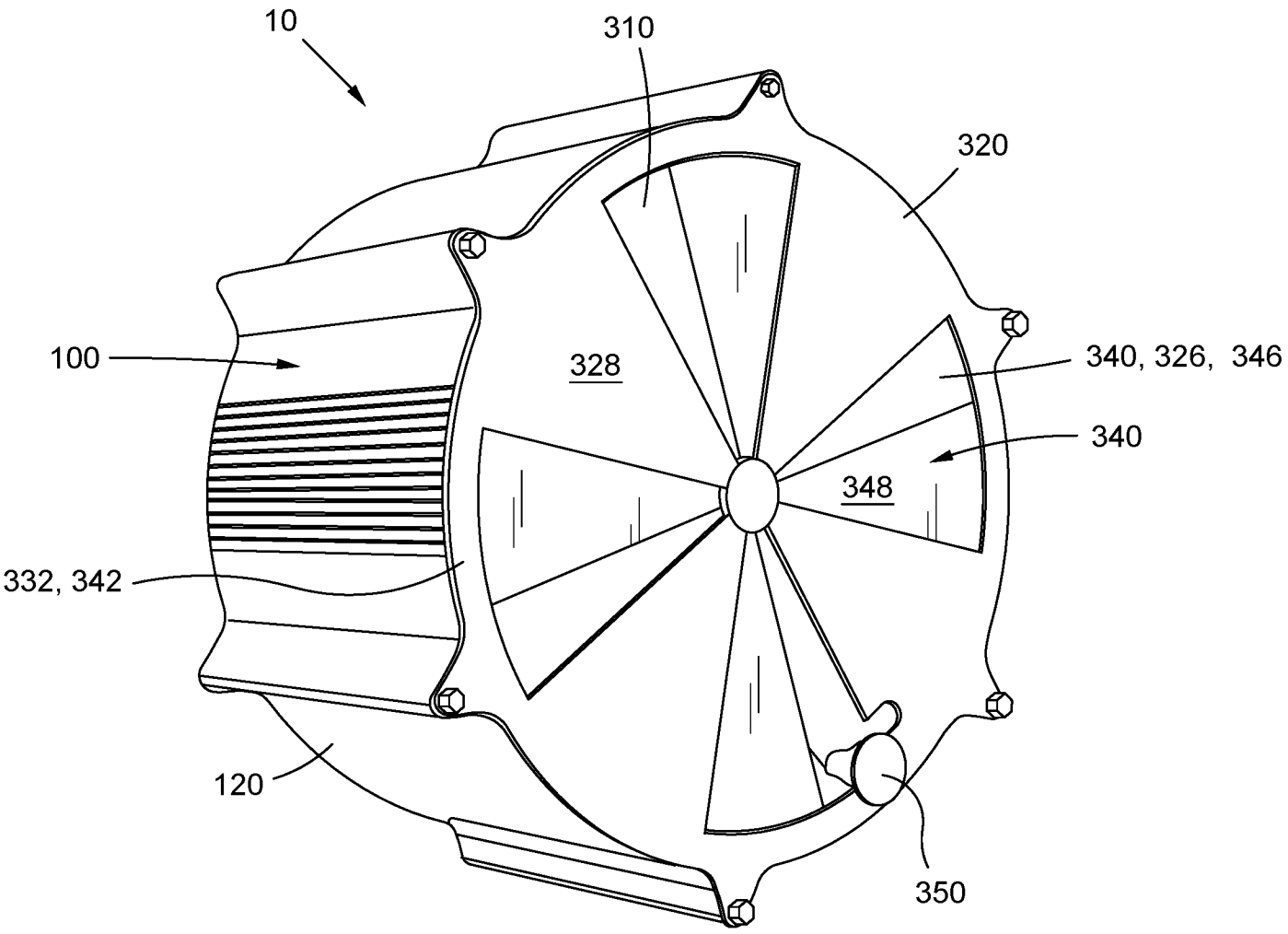
Figure 4:
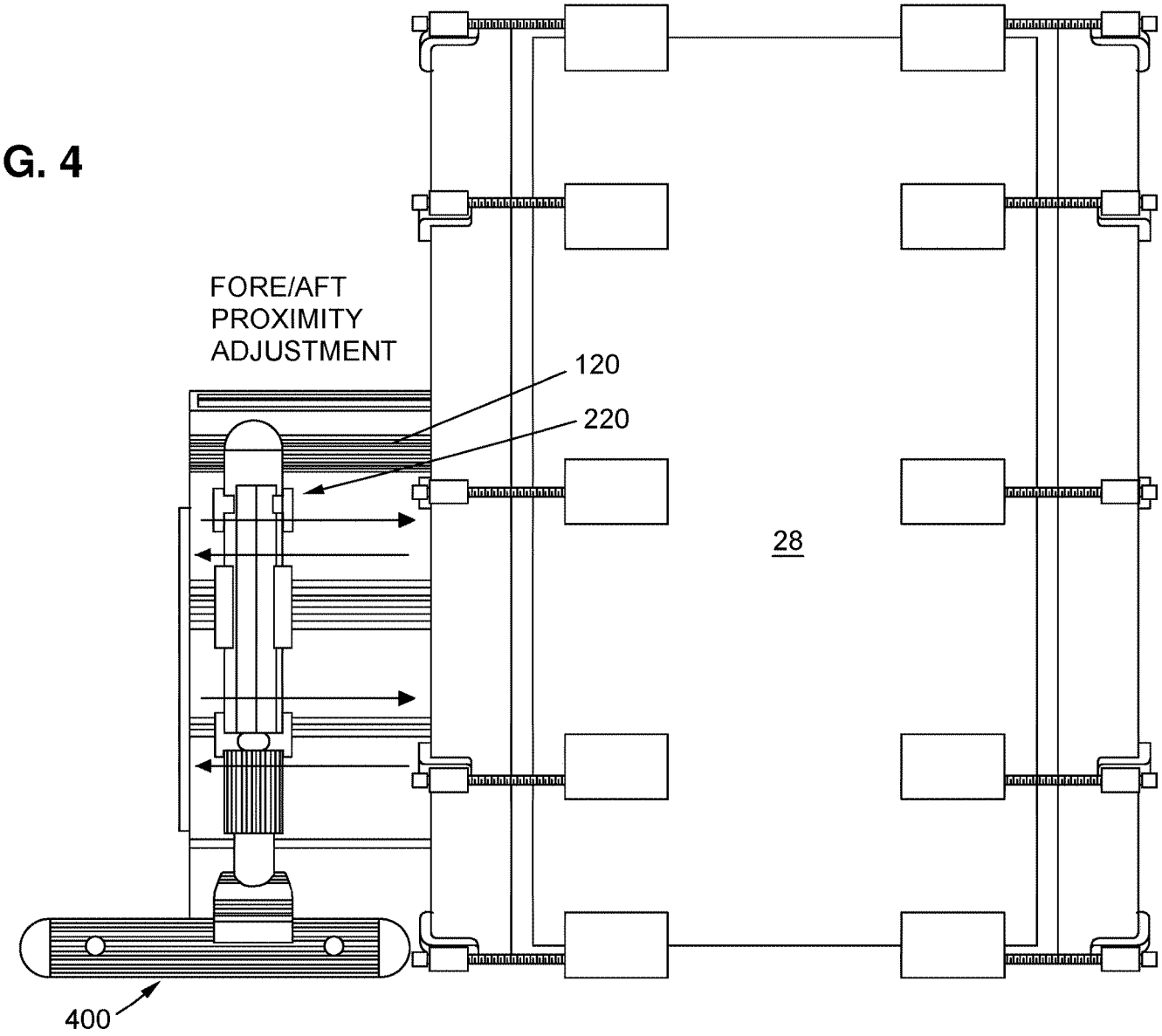
Figure 5:
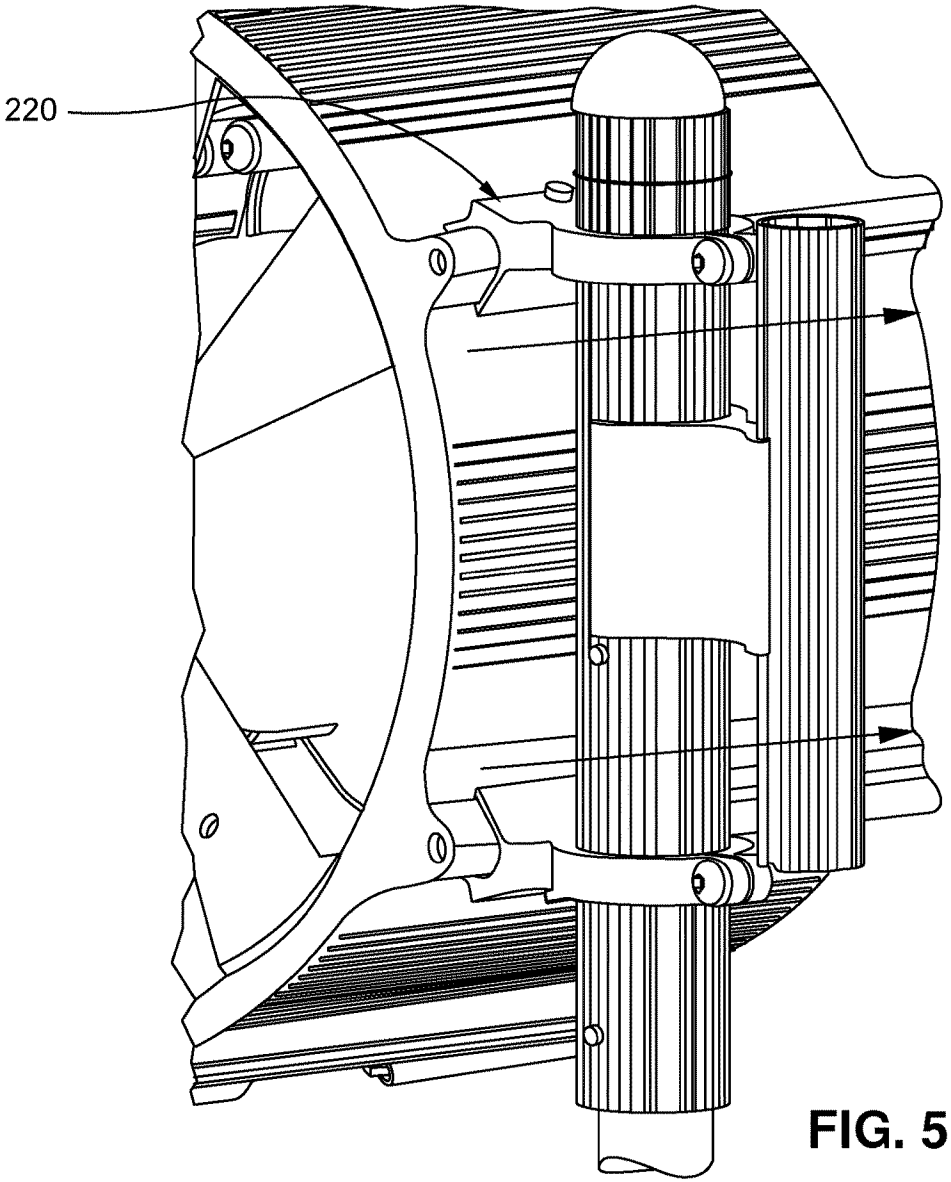
Figure 6:
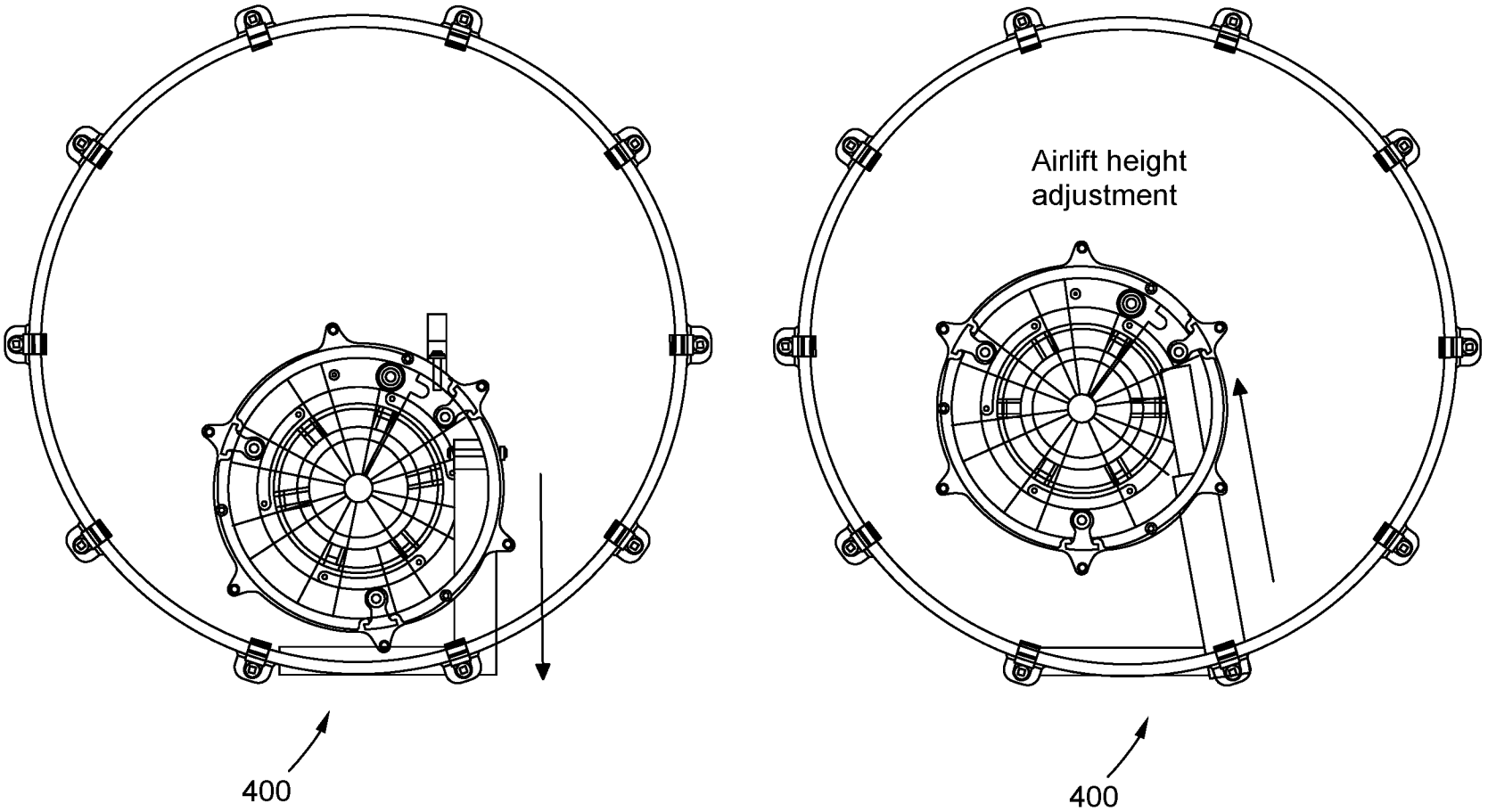

The above described drawing figures illustrate the described invention in at least one of its preferred, best mode embodiment, which is further defined in the following description. Those having ordinary skill in the art may be able to make alterations and modifications to what is described herein without departing from its spirit and scope. While the described invention is susceptible of embodiment in many different forms, there is shown in the drawings and will herein be described in detail at least a preferred embodiment of the invention with the understanding that the present disclosure is to be considered as an exemplification of the principles of the invention and is not intended to limit the broad aspect of the invention to the embodiment illustrated. Therefore, it should be understood that what is illustrated is set forth only for the purposes of example and should not be taken as a limitation on the scope of the described invention.

An exemplary sub-kick system 10 according to at least one embodiment of the invention will now be described with reference to FIGS. 1-6. The sub-kick system generally comprises: a housing 100 enclosing a drum facing sub-kick speaker-microphone 200 therein, and an acoustic variable porting element (AVP) 300 secured thereto opposite the speaker-microphone 200. The system may also comprise one or more sub-kick stands 400 configured to support the housing thereon.

The housing may comprise a hollow housing having interior 110 and exterior 120 surfaces. One or more speaker-microphone mounts 210 may attach the speaker-microphone to the interior surface of the housing. The one or more sub-kick stands may also be attached to the housing via one or more stand mounts 220. The attachment may be at the interior surface—in which case the stand extends through the housing to attach to the interior of the surface via one or more stand mounts. The sub-kick stand may alternatively be attached to the exterior surface via one or more stand mounts. In at least one embodiment, the mounts comprise intermediate appendages coupling the speaker-microphone and/or the sub-kick stand to the housing, as appropriate.

The AVP may include one or more ports 310, or openings, whose areas are readily adjustable by the user, either mechanically or electrically or by any other means of adjustment. The AVP may include a stationary register 320 whose position on the sub-kick is fixed, and an adjustable register 340 configured to be repositioned with respect to the stationary register so as to adjust the size of the ports.

Turning now to FIGS. 1-6, the stationary register may comprise a generally circular body having a perimeter 322 generally defined by an outer radius, and corresponding to a perimeter of a cylindrical housing. One or more mounting appendages 324 may extend from the perimeter so as to engage mounting appendages of the housing, securely mounting the stationary register to the housing opposite the speaker-microphone, thereby enclosing the speaker-microphone within the housing.

The stationary register body may include one or more apertures 326, which may correspond to partial geometric sectors defined by radians less than the outer radius and arc-angles less than 360 degrees. Non-aperture portions 328 of the stationary register body may separate the apertures such that the apertures are radially spaced apart.

The adjustable register may comprise an adjustable register body that is formed similarly to the stationary register body, having both aperture 346 and non-aperture 348 portions. The adjustable register may be coaxially mounted substantially flush with the stationary register. Such mounting may be via a central mount at an axial pivot point, and/or a perimeter mounting via an edge frame.

The adjustable register may be rotated with respect to the stationary register between an open position, in which the relative apertures are generally aligned, thereby forming the ports at their largest size, and a closed position, in which the relative apertures are generally misaligned, thereby closing the ports. It will be understood that the rotation may also be to an intermediate position, in which the relative apertures are semi-aligned, thereby forming the ports at an intermediate size. It will also be understood, that the non-aperture portions of each body preferably sweep out more area than the corresponding apertures, such that the ports may be fully closed. However, it is not necessary that the ports be configured to fully close or fully open.

The adjustable register may further include one or more protrusions 350 extending from the body at one or more of the non-aperture portions, through the corresponding aperture of the stationary register. The protrusion may function as a grip or a handle for the user to utilize in manually rotating the adjustable register. The protrusion may also function as a stop for stopping the rotation via coming up against the non-aperture portion of the stationary register.

The longitudinal position of the speaker-microphone may further be adjustable within the sub-kick housing. To that end, the speaker-microphone mounts may comprise one or more tongue-in-groove or other rail type mounts that permit the longitudinal adjustment. The speaker-microphone mounts may also include a shock-absorbing elastomer between the speaker-microphone and the sub-kick housing.

The system may be configured such that the longitudinal position of the sub-kick housing may be adjustably set with respect to the bass drum (or other sound source). To that end, the stand mounts may comprise one or more tongue-in-groove or other rail type mounts that permit the longitudinal adjustment.

The system may be further configured such that the height of the sub-kick housing may be adjustably set. For example, the inventor's AIRlift™ technology may be utilized to set the height of the sub-kick, which AIRlift™ is known to those of ordinary skill in the art.

An exemplary ported drum head system 20 according to at least one embodiment of the invention will now be described with reference to FIGS. 7-9 and 15-10. The ported drum head system generally comprises: a drum 22 having a shell 28 and a drum head 24 with a drum head port 26, and the AVP.

The static register of the AVP may be mounted internally to the drum shell, via one or more mounts, so as to overlap the drum head port and be substantially flush with the drum head. The AVP may further comprise a sealing structure, such as a felt lining (not shown), that provides a substantial acoustic seal and/or resonant damming between the static register and the drum head.

Figure 7:
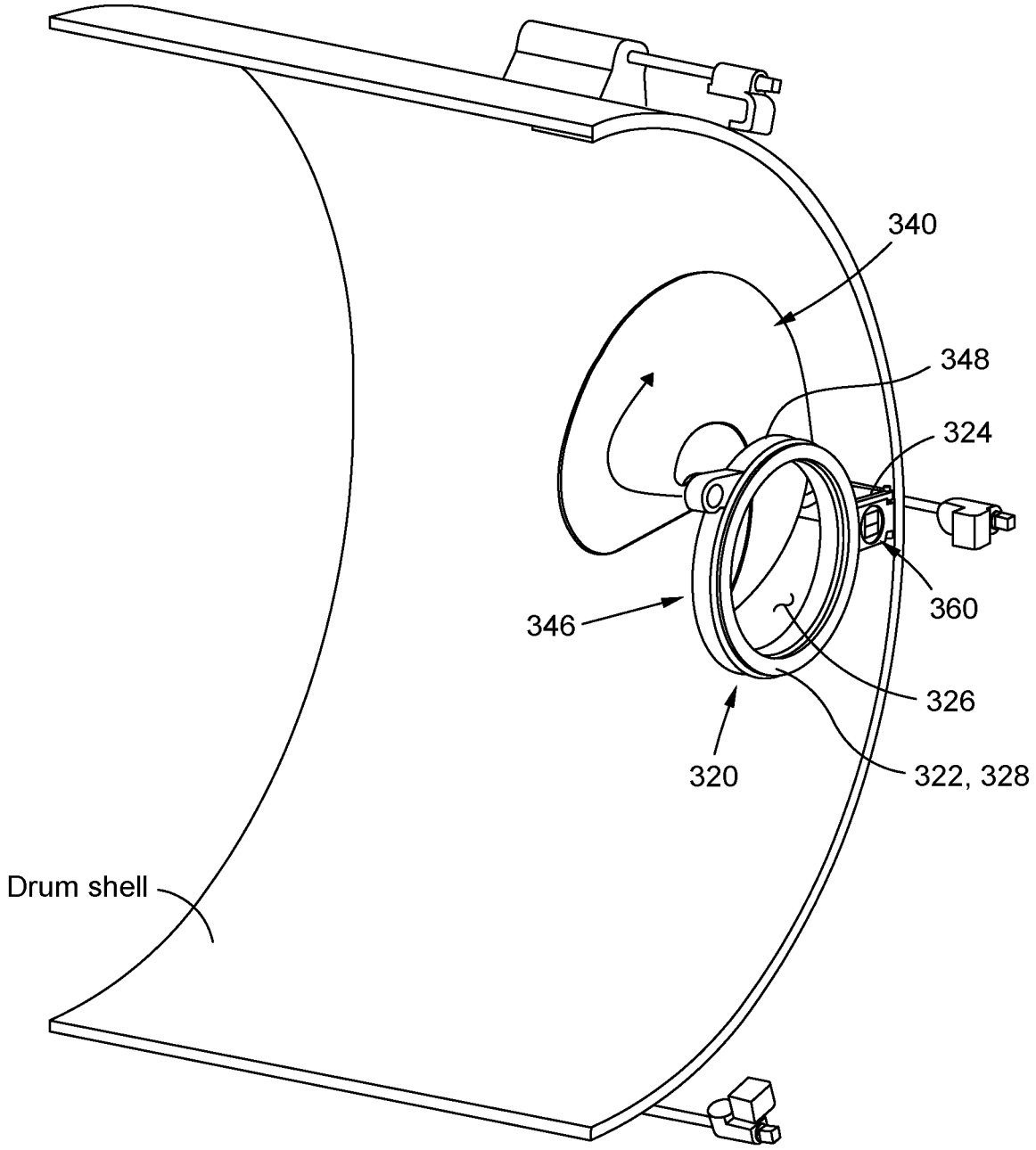
FIGS. 7-9 and 11 illustrate an exemplary AVP ported structure for a resonate drum head system according to at least one embodiment.
Figure 8:
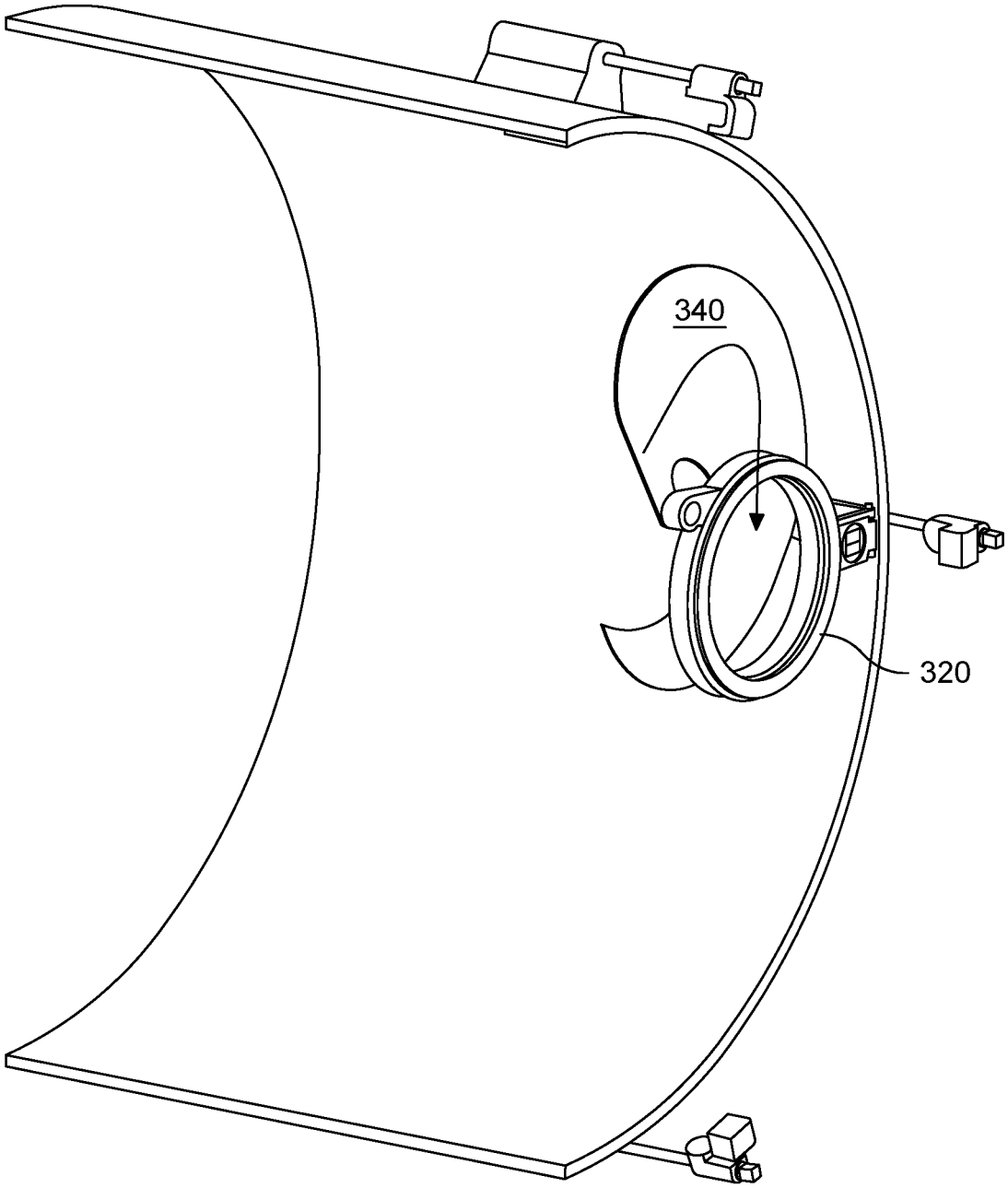
Figure 9:
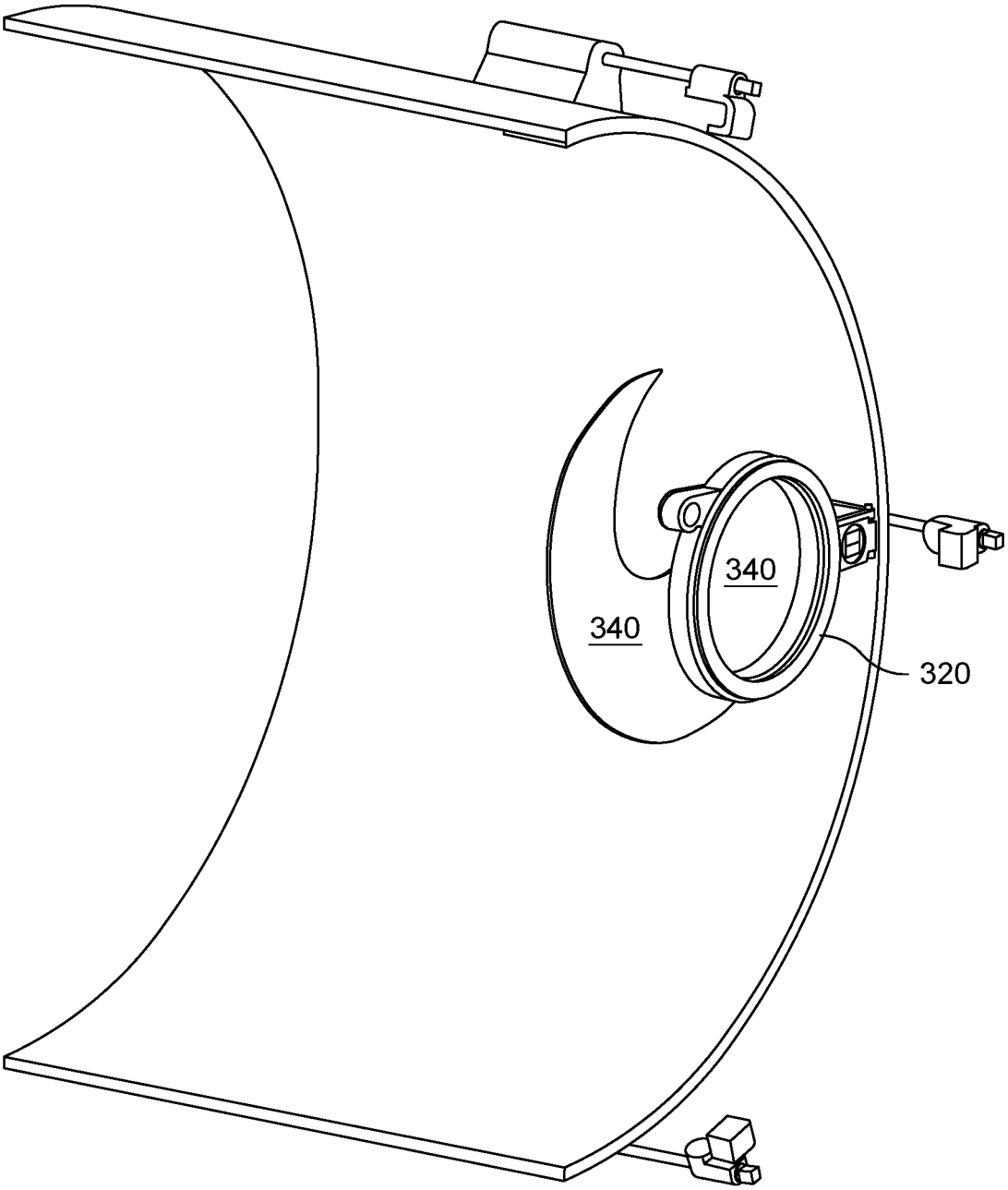

Unlike the AVP shown in FIGS. 1-6, the stationary register of the AVP shown in FIGS. 7-9 includes a single aperture, and the adjustable register is a half-yin-yang like shape having a larger portion tapering to a smaller portion. The adjustable register may be rotationally mounted to the stationary register at a mounting point that is central to the adjustable register but along or adjacent to the perimeter of the stationary register.

The mounting of the adjustable register to the stationary register may be such that the adjustable register may be rotated with respect to the stationary register between the closed position, in which the larger portion of the half-yin-yang is generally aligned with the single aperture, thereby closing the port, and the open position, in which the larger portion of the half-yin-yang is generally misaligned with the single aperture, thereby forming the port with its larger size. It will be understood that the rotation may also be to an intermediate position, in which the half-yin-yang and the central aperture are semi-aligned, thereby forming the port at an intermediate size.

Figure 11:
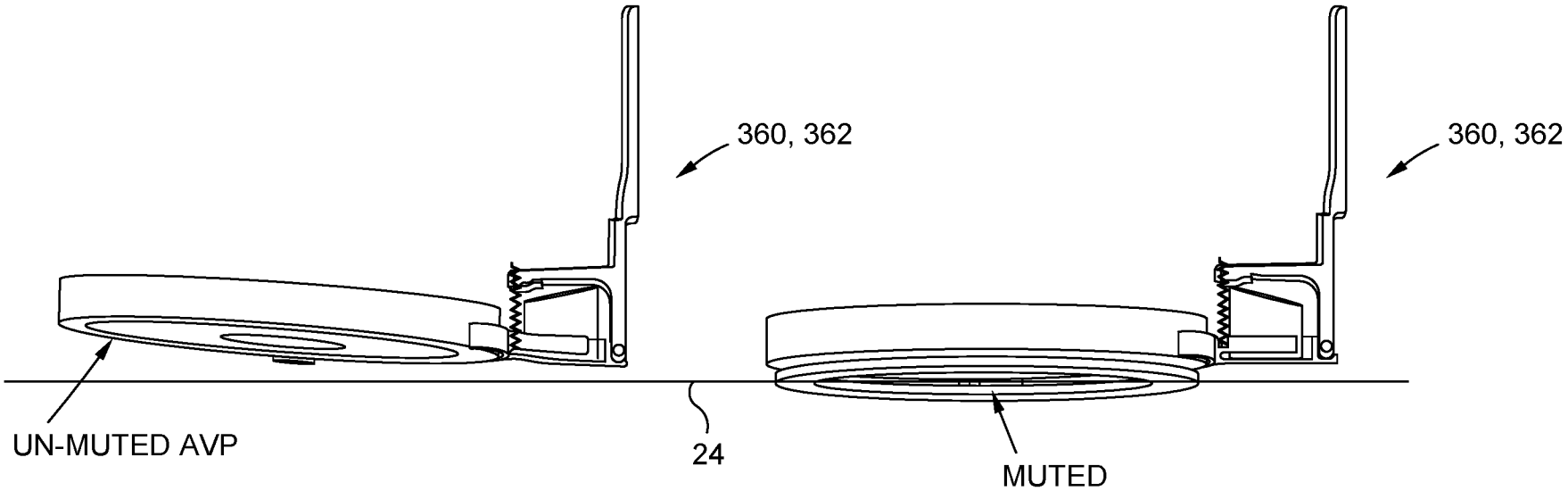

In some embodiments, the adjustment of the adjustable register occurs via a magnetic cam structure 360 (FIG. 11). The magnetic cam structure is coupled to the adjustable register and is accessible to the user external to the drum. The magnetic cam structure further includes an interface by which the user may cause the magnetic cam structure to alter the proximity to the resonate head and/or to rotate the adjustable register.

Figure 10:
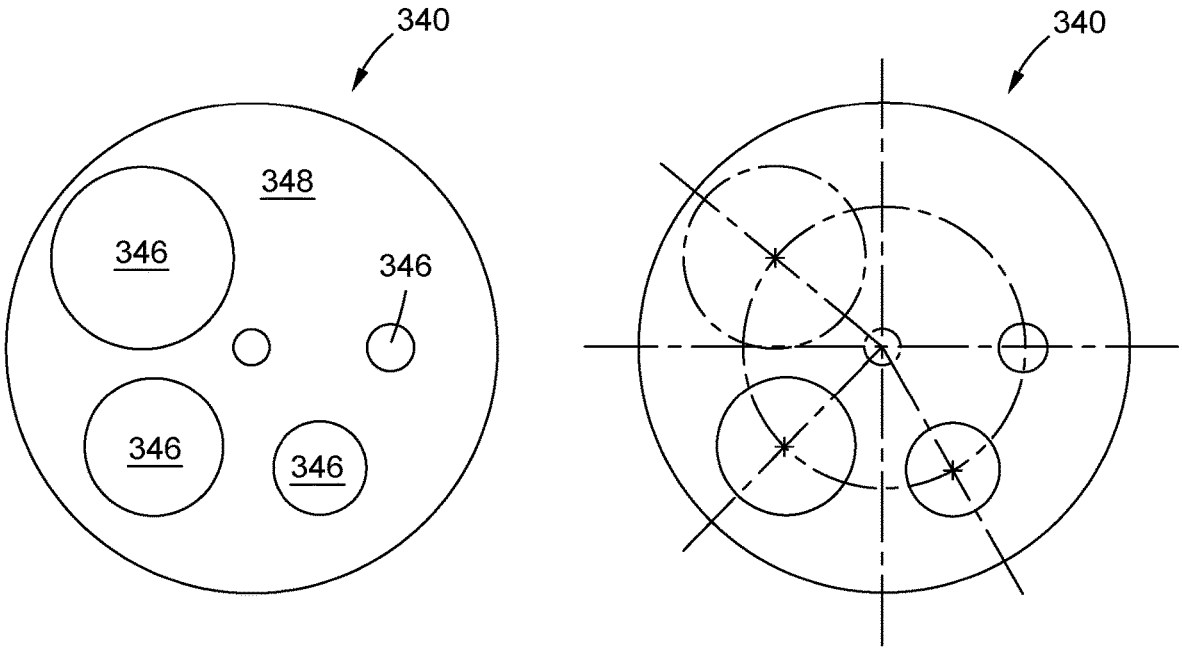
FIG. 10 illustrates an exemplary AVP geometry according to at least one embodiment.

FIG. 10 shows a further example of the adjustable register for an AVP according to the disclosed invention. The adjustable register of FIG. 10 comprises a generally circular body having a plurality of angularly successive apertures progressively decreasing/increasing in size. Each of the apertures have centers located at a common radius from the center of the body of the adjustable register. The adjustable register may also be rotationally fixed along or adjacent to the perimeter of the single aperture stationary register such that rotation of the adjustable register progressively aligns the single aperture with a different one of the adjustable register's apertures.

It will be further understood that, in this embodiment, the single aperture of the stationary register is preferably the size of the largest of the adjustable register's apertures. It will also be understood that the adjustable register may include a non-aperture portion the alignment of which to the single aperture of the stationary register closes the port.

The ported drum head system may further include a setting mechanism 362 for setting the longitudinal position of the AVP within the drum frame—thereby adjusting the proximity of the AVP to the drum head. To that end, the one or more mounts by which the AVP is mounted to the drum shell may comprise one or more tongue-in-groove or other rail type mounts that permit the longitudinal adjustment. FIG. 11 shows an exemplary mechanism for setting the longitudinal position of the AVP within the drum shell—thereby adjusting the proximity of the AVP to the drum head. The mechanism may be part of the magnetic cam structure discussed above.

Figure 12:
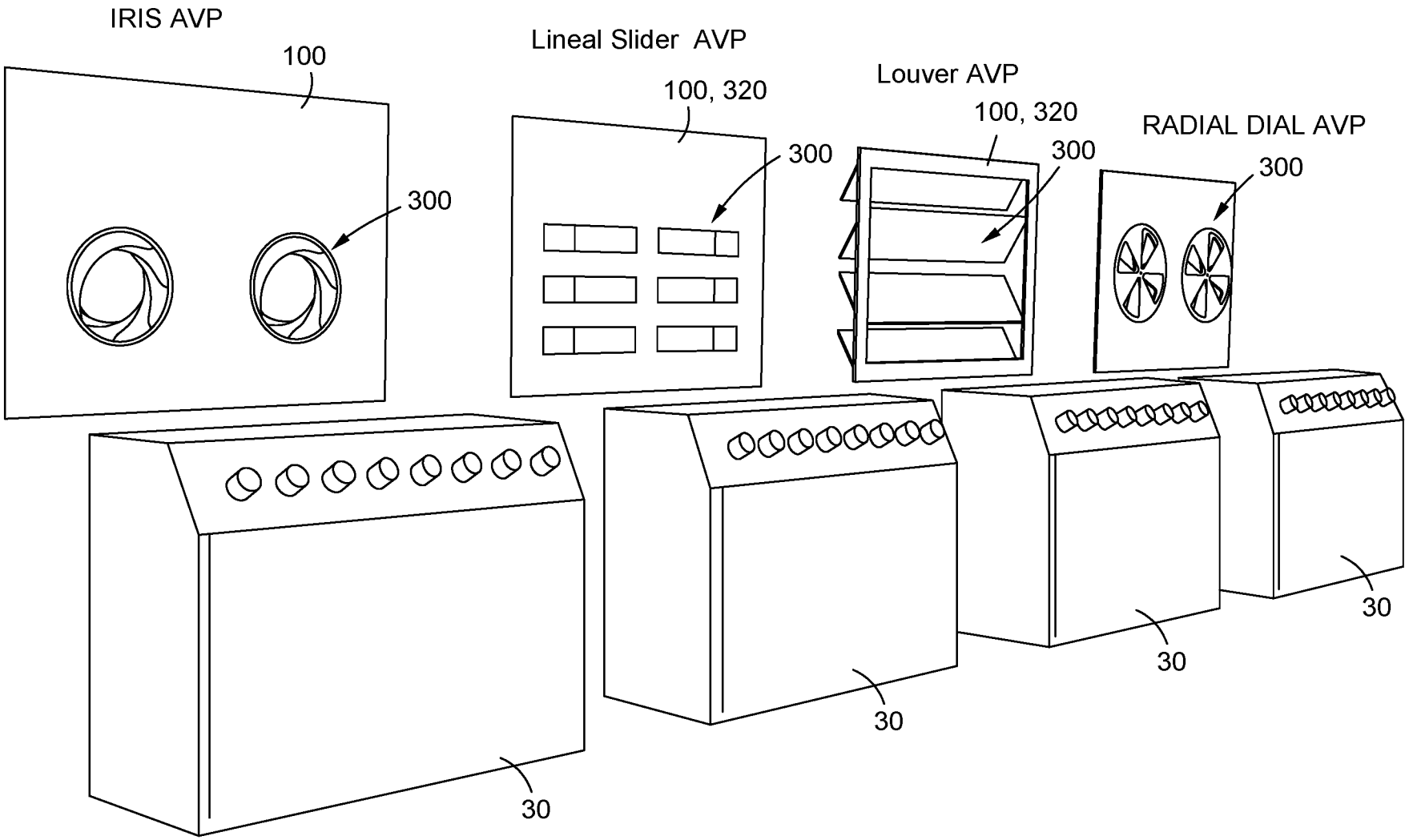
FIGS. 12-14 illustrate an exemplary AVP speaker system according to at least one embodiment.
Figure 13:
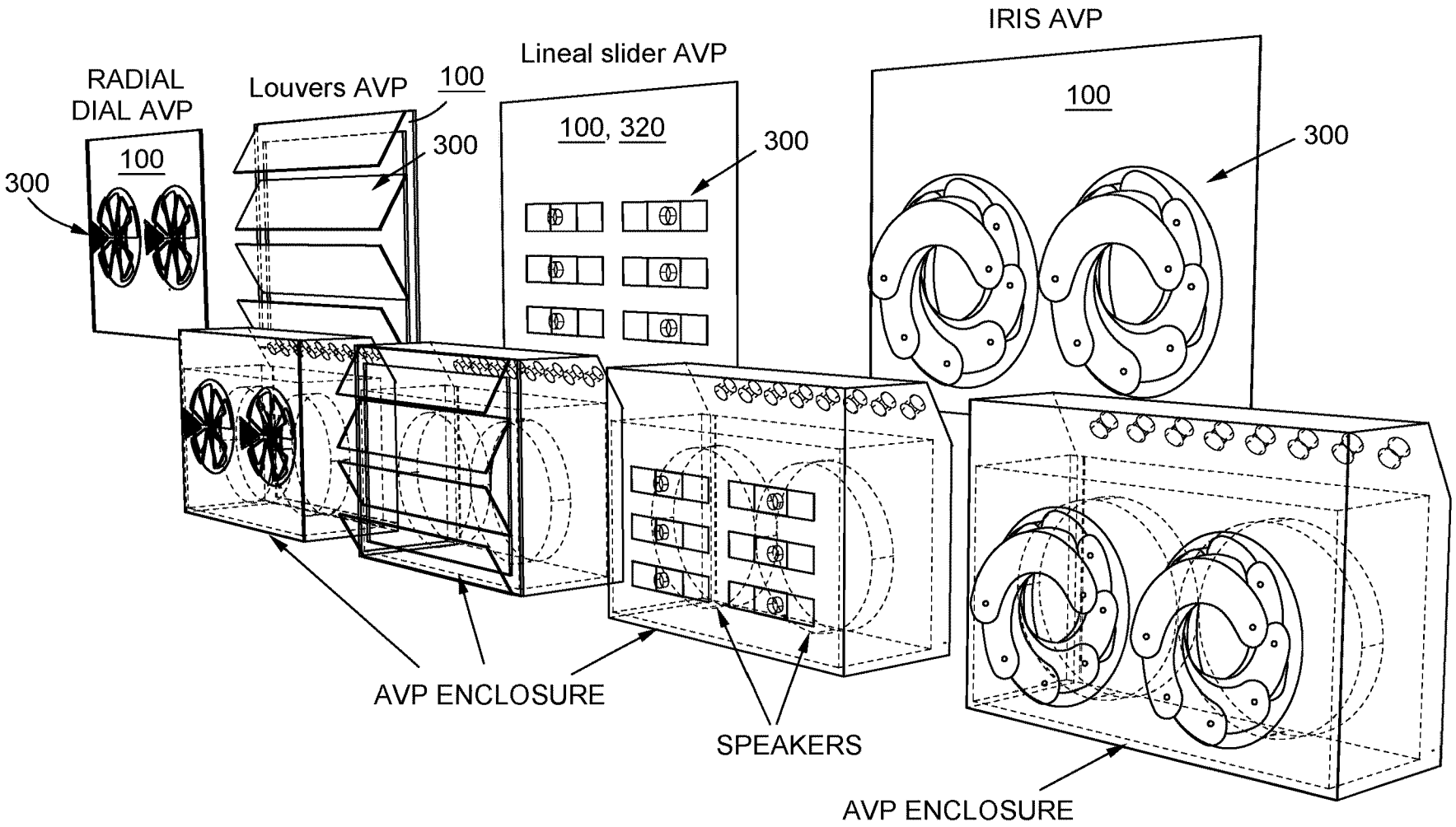
Figure 14:
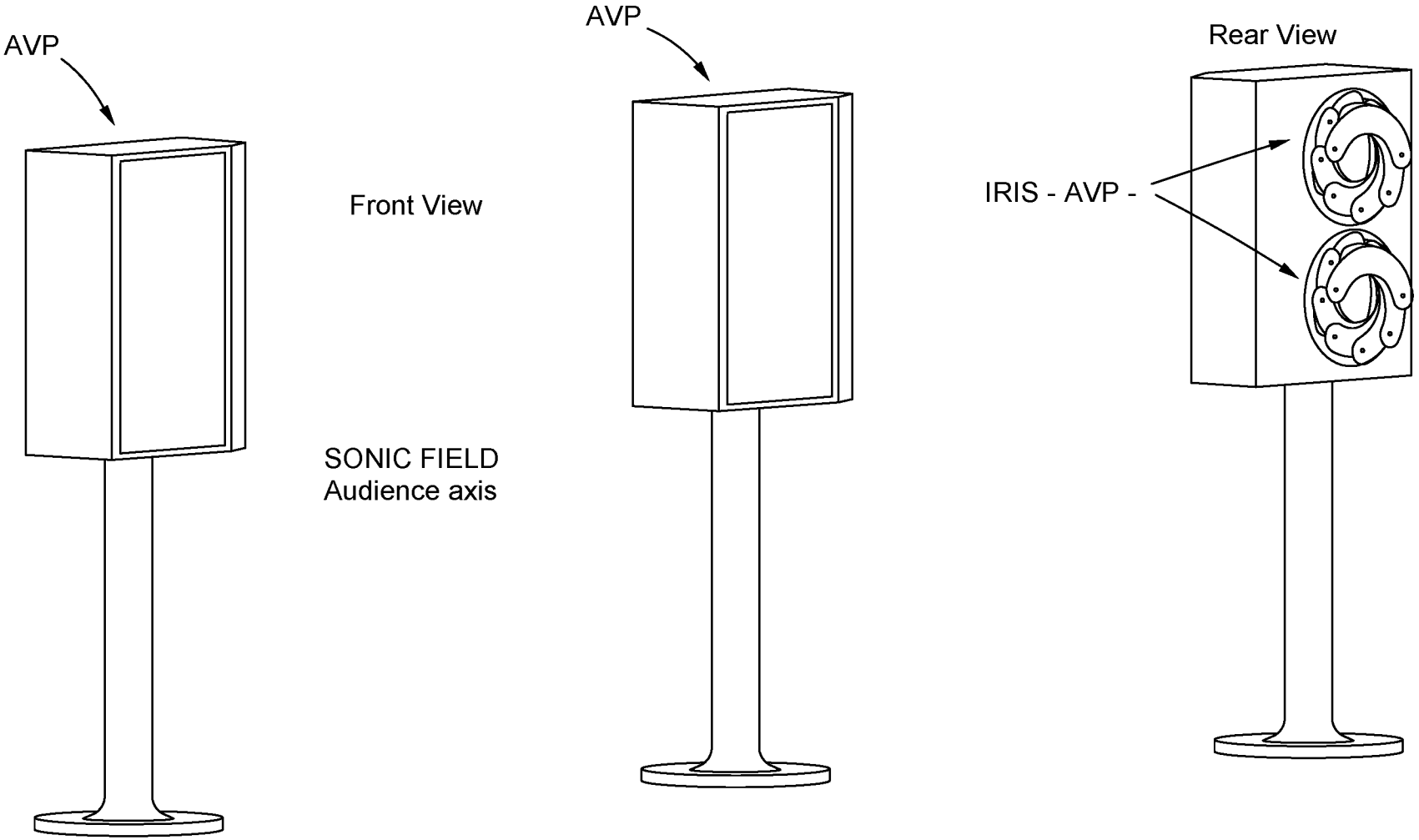
Figure 15:
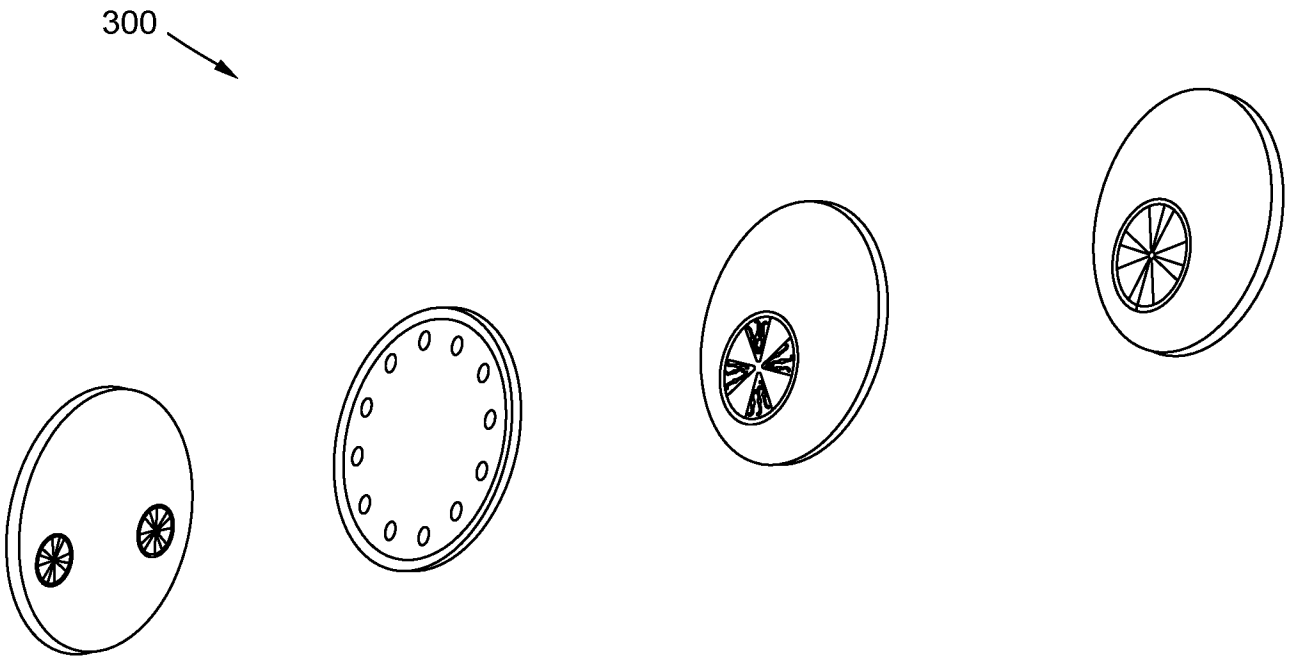
FIGS. 15-20 illustrates exemplary AVP geometries according to at least one embodiment.
Figure 17:
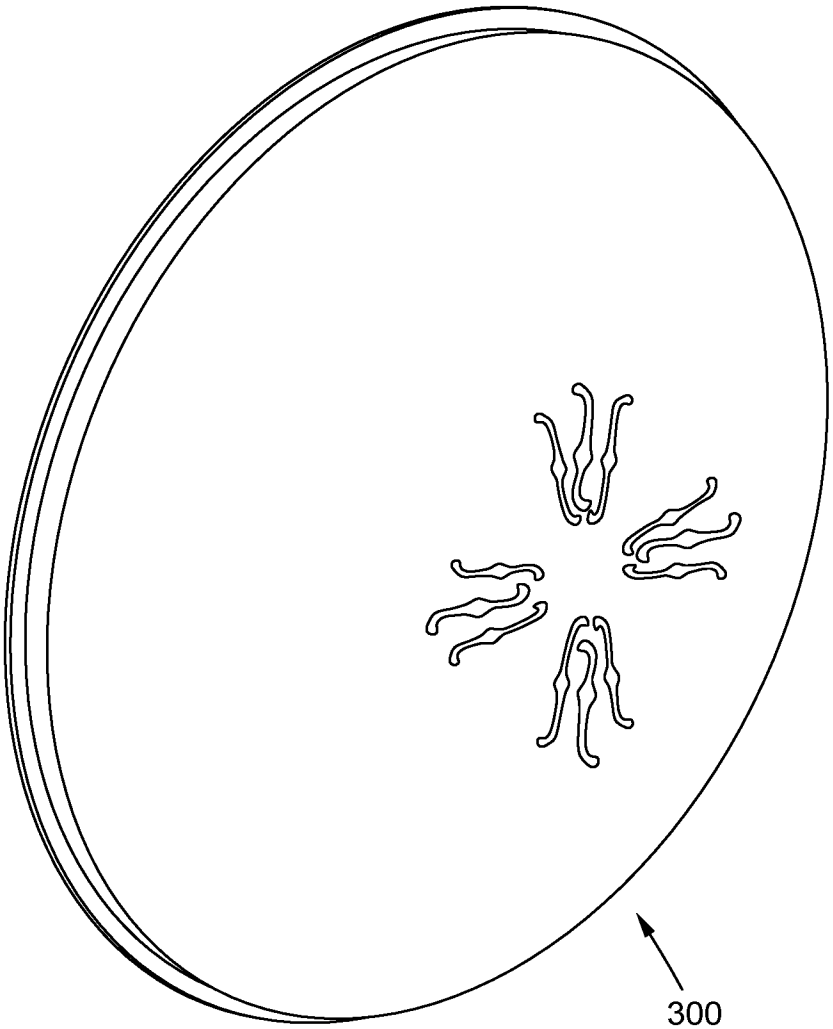
Figure 16:
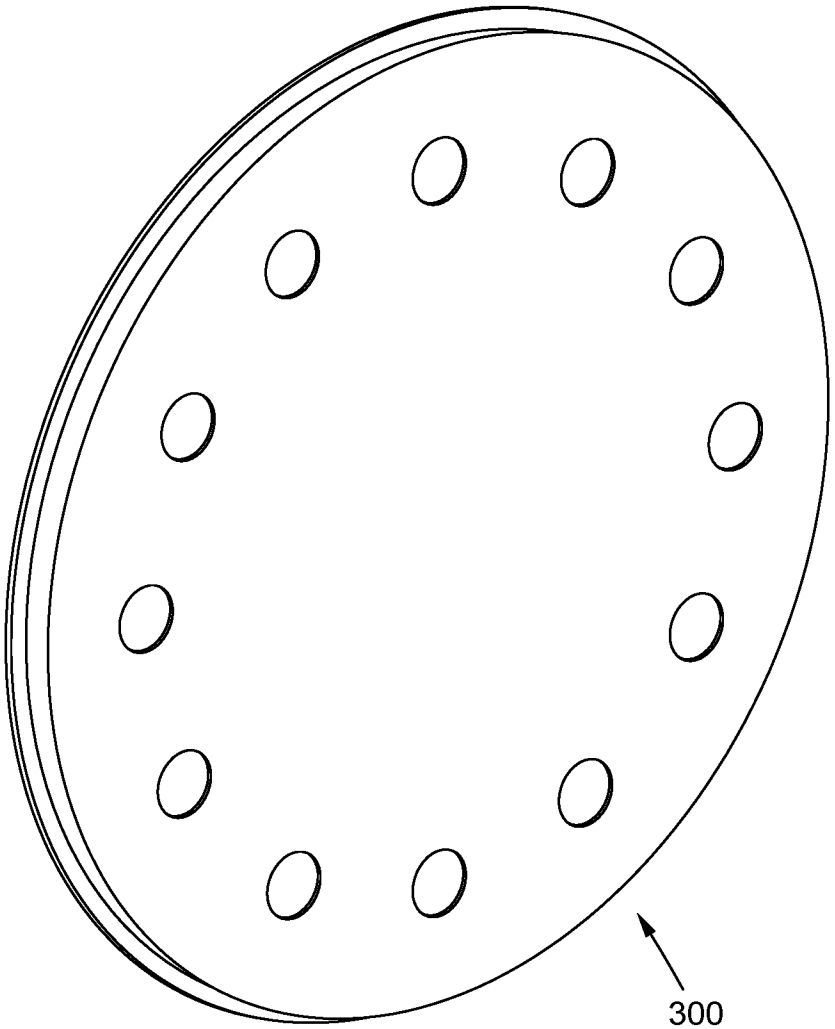
Figure 19:
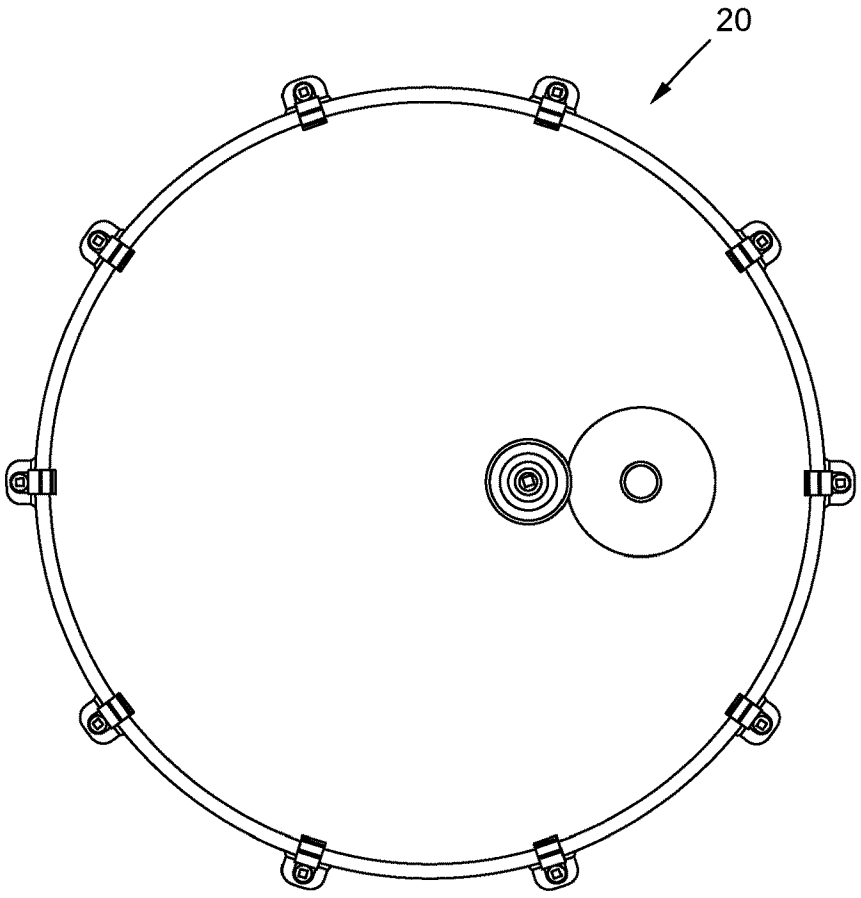
Figure 18:
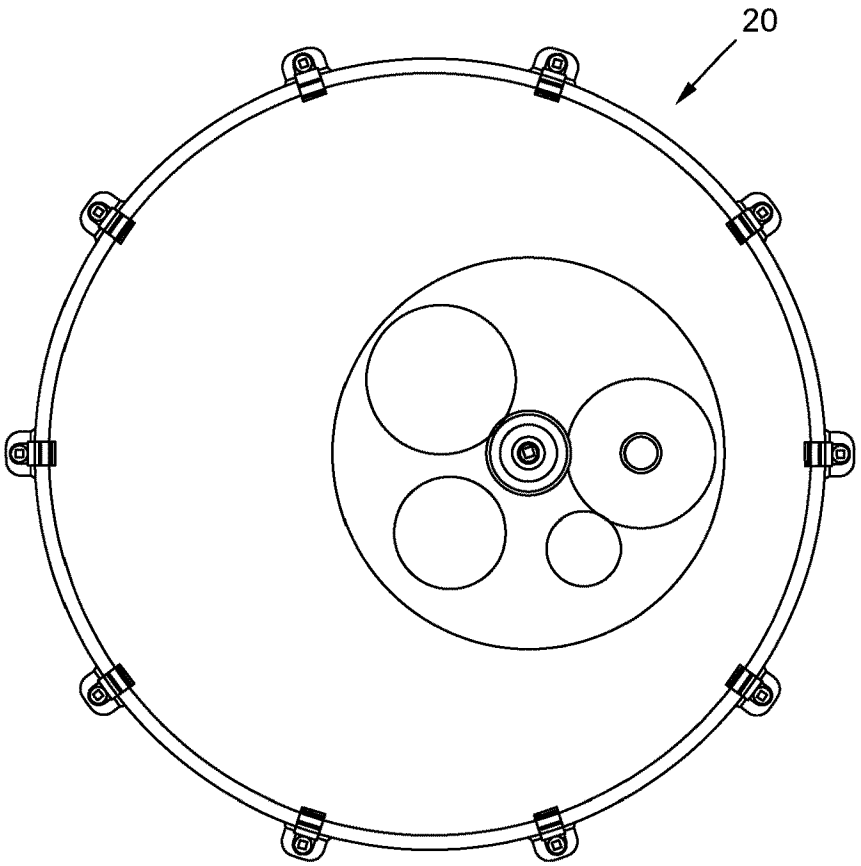
Figure 20:
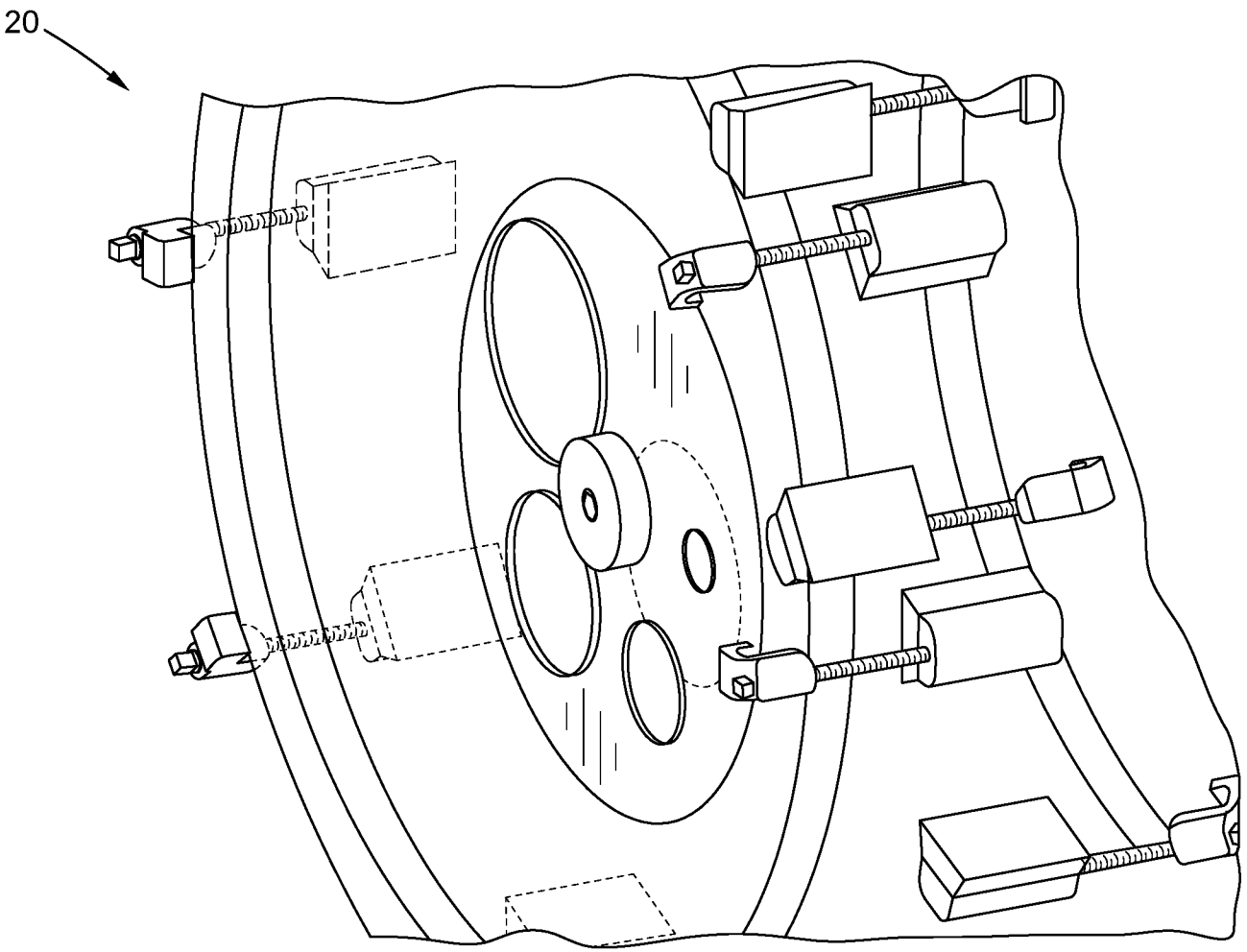

An exemplary ported speaker/amplifier system 30 according to at least one embodiment of the invention will now be described with reference to FIGS. 12-14. The ported speaker system generally comprises: speaker/amplifier housings 100 and the AVP 300, which are configured in accordance with the principles of the invention discussed above. FIGS. 12-14 also show various alternative geometries for the AVP. Such geometries may include closing/opening iris, lineal slider, louvers, and radial dial geometries.

The radial dial geometry is generally similar to the AVP geometry discussed above with reference to FIGS. 1-6, and will not be further described here for the sake of brevity.

The lineal slider geometry generally comprises stationary and adjustable registers, each having a plurality of corresponding linear apertures. Lateral adjustment of the adjustable register with respect to the stationary register aligns and misaligns the corresponding apertures so as to open, close and adjust the size of the linear ports formed thereby, in accordance with the principles discussed herein.

The louvers geometry generally comprises adjustable louvers covering corresponding apertures (or a single aperture). In accordance with the principles discussed herein, rotation of the louvers aligns/misaligns the louvers with the aperture so as to open, close and adjust the size of the ports formed thereby.

The iris geometry generally comprises a plurality of curvilinear adjustable registers rotationally fixed at respective first ends in a ring about a corresponding single aperture of a stationary register. In accordance with the principles discussed herein, rotation of the curvilinear adjustable registers opens, closes, and adjusts the size of the port formed thereby.

FIGS. 15-20 show various examples of AVPs integrated into a resonant ported drum head according to the disclosed invention. As is apparent from the figures, the AVP may be mounted on the drum head rather than the drum shell, and may be integral thereto. As is further apparent from the figures, a grip may be provided such that the user may rotate the variable register with respect to the stationary register.

Other features and details are readily apparent from the figures, and are not discussed in-depth herein for the sake of efficiency. However, all features, structures and operations thereof that would be apparent from this disclosure to one of ordinary skill in the art are expressly contemplated.

The objects, advantages and features described in detail above are considered novel over the prior art of record and are considered critical to the operation of at least one embodiment of the present invention and to the achievement of at least one objective of the present invention. The words used in this specification to describe these objects, advantages and features are to be understood not only in the sense of their commonly defined meanings, but also to include any special definition with regard to structure, material or acts that would be understood by one of ordinary skilled in the art to apply in the context of the entire disclosure.

As used herein, the terms "a" or "an" shall mean one or more than one. The term "plurality" shall mean two or more than two. The term "another" is defined as a second or more. The terms "including" and/or "having" are open ended (e.g., comprising). The term "or" as used herein is to be interpreted as inclusive or meaning any one or any combination. Therefore, "A, B or C" means "any of the following: A; B; C; A and B; A and C; B and C; A, B and C. An exception to this definition will occur only when a combination of elements, functions, steps or acts are in some way inherently mutually exclusive.

Reference throughout this document to "one embodiment", "certain embodiments", "an embodiment" or similar term means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner on one or more embodiments without limitation.

Moreover, the definitions of the words or drawing elements described herein are meant to include not only the combination of elements which are literally set forth, but all equivalent structures, materials or acts for performing substantially the same function in substantially the same way to obtain substantially the same result. In this sense, it is therefore contemplated that an equivalent substitution of two or more elements may be made for any one of the elements described and its various embodiments or that a single element may be substituted for two or more elements in a claim without departing from the scope of the present invention.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted in conjunction with the appended claims.

What is claimed is:

1. An acoustic variable porting system, comprising:

an acoustic element that emits sound;

an acoustic variable porting element comprising:

a stationary register configured to be mounted to a housing adjacent to a resonant chamber;

an adjustable register configured to be juxtaposedly mounted to the stationary register such that a degree of planar-rotational alignment between the stationary register and the adjustable register forms a port into the resonant chamber, wherein the port is positioned off-axis with respect to the resonant chamber, and wherein the size of the port is adjustable by adjusting the degree of planar-rotational alignment such that sound from the acoustic element is altered.

2. The acoustic variable porting system of claim 1, wherein adjusting the degree of planar-rotational alignment alters the acoustic venting of the resonant chamber so as to alter the sound.

3. The acoustic variable porting system of claim 1, wherein adjusting the degree of planar-rotational alignment alters the back pressure ratio of the resonant chamber so as to alter the sound.

4. The acoustic variable porting system of claim 1, wherein adjusting the degree of planar-rotational alignment alters the air flow rate through the port into and/or out of the resonant chamber so as to alter the sound.

5. The acoustic variable porting system of claim 1, wherein the acoustic element includes the resonant chamber.

6. The acoustic variable porting system of claim 1, wherein the porting element is mounted to the acoustic element.

7. The acoustic variable porting system of claim 1, wherein the degree of planar-rotational alignment is magnetically adjustable between the open position and the closed position.

8. The acoustic variable porting system of claim 1, wherein the acoustic element comprises an amplifier cabinet.

9. The acoustic variable porting system of claim 8, wherein the amplifier cabinet includes the resonant chamber.

10. An acoustic variable porting element for use with an acoustic element that emits sound into a resonant chamber, comprising:

a stationary register configured to be mounted to a housing adjacent to a resonant chamber;

an adjustable register configured to be juxtaposedly mounted to the stationary register such that a degree of planar-rotational alignment between the stationary register and the adjustable register forms a port into the resonant chamber, wherein the port is positioned off-axis with respect to the resonant chamber, and wherein the size of the port is adjustable by adjusting the degree of planar-rotational alignment such that sound from the acoustic element is altered.

11. The acoustic variable porting element of claim 10, wherein adjusting the degree of planar-rotational alignment alters the acoustic venting of the resonant chamber so as to alter the sound.

12. The acoustic variable porting element of claim 10, wherein adjusting the degree of planar-rotational alignment alters the back pressure ratio of the resonant chamber so as to alter the sound.

13. The acoustic variable porting element of claim 10, wherein adjusting the degree of planar-rotational alignment alters the air flow rate through the port into and/or out of the resonant chamber so as to alter the sound.

14. The acoustic variable porting element of claim 10, wherein the acoustic element includes the resonant chamber.

15. The acoustic variable porting element of claim 10, wherein the porting element is mountable to the acoustic element.

16. The acoustic variable porting element of claim 10, wherein the degree of planar-rotational alignment is magnetically adjustable between the open position and the closed position.

17. The acoustic variable porting element of claim 10, wherein the acoustic element comprises an amplifier cabinet.

18. The acoustic variable porting element of claim 17, wherein the amplifier cabinet includes the resonant chamber.

* * * * *